US007055289B2

(12) United States Patent
Guth

(10) Patent No.: US 7,055,289 B2
(45) Date of Patent: Jun. 6, 2006

(54) SYSTEM AND METHOD FOR FORMING A STRUCTURAL CONNECTION

(75) Inventor: Paul W. Guth, Meniffe, CA (US)

(73) Assignee: Masonry Technology, Inc., Morano Valley, CA (US)

( * ) Notice: Subject to any disclaimer, the term of this patent is extended or adjusted under 35 U.S.C. 154(b) by 162 days.

(21) Appl. No.: 10/412,930

(22) Filed: Apr. 14, 2003

(65) Prior Publication Data

US 2004/0200166 A1 Oct. 14, 2004

(51) Int. Cl.
*E04B 1/16* (2006.01)

(52) U.S. Cl. ..... 52/378; 52/379; 52/327; 52/506.1; 52/699; 52/712; 52/715; 248/201; 248/247; 248/475.1; 248/497

(58) Field of Classification Search ..... 52/699, 52/712, 715, 378, 379, 327, 506.1; 248/201, 248/247, 475.1, 497
See application file for complete search history.

(56) References Cited

U.S. PATENT DOCUMENTS 2,340,439 A * 2/1944 Strogen ..... 249/219.2
2,570,731 A * 10/1951 Susnow ..... 248/247
2,879,576 A * 3/1959 Imonetti ..... 249/192
3,989,215 A * 11/1976 Weston ..... 248/225.11
4,270,719 A * 6/1981 Kellogg ..... 248/235
4,460,147 A * 7/1984 Macbain ..... 248/542
5,110,083 A * 5/1992 Page ..... 249/46
5,555,694 A 9/1996 Commins
5,749,680 A * 5/1998 Hilfiker et al. ..... 405/262
5,813,175 A * 9/1998 Hiragaki ..... 52/167.1
5,885,024 A * 3/1999 Zupan et al. ..... 403/389
6,065,724 A * 5/2000 Arslan et al. ..... 248/248
6,085,821 A * 7/2000 Roberts ..... 160/38
6,131,361 A * 10/2000 Murphy ..... 52/712
6,286,285 B1 * 9/2001 Martell ..... 52/712
6,517,293 B1 * 2/2003 Taylor et al. ..... 405/302.4
6,604,326 B1 * 8/2003 Noble ..... 24/455

OTHER PUBLICATIONS

Hilti Systems and Solutions 2000 Catalog; Section 9 p. 34; Retainer Straps and Assorted Screws.
Hilti Systems and Solutions 2000 Catalog; Section 9 p. 38; Standard U–Bolt.
Simpson Strong–Tie Co., Inc.; Catalog C–2002; Wood Construction Connectors.
Page 124 LGT2/MGT/HGT Heavy Girder Tiedowns.
Page 125 H16S Seismic and Hurricane Ties.
Page 125 HGAM10 Seismic and Hurricane Ties.
Page 125 HM9 Seismic and Hurricane Ties.

* cited by examiner

*Primary Examiner*—Carl D. Friedman
*Assistant Examiner*—Christy M. Green
(74) *Attorney, Agent, or Firm*—Greer, Burns & Crain, Ltd.

(57) ABSTRACT

A system for making a structural connection includes a structural member, a plurality of strips for engaging the structural member and securing devices for securing the strips to a building structure that supports the structural member. The method of making the structural connection includes the steps of providing the structural member, inserting a segment of the structural member into the hollow of a building structure, and securing the structural member to the building structure with two or more strips.

20 Claims, 6 Drawing Sheets

SYSTEM AND METHOD FOR FORMING A STRUCTURAL CONNECTION

BACKGROUND OF THE INVENTION

1. Field of the Invention

The present invention relates to a system and method for forming a structural connection, and more particularly to a system and method for embedding connecting members into masonry walls or other such building structures.

2. Description of Prior Art

Building constructions typically include connections between various structures such as walls, floors and roofs. For example, in some building designs, the roof lies below the top of exterior walls, creating a parapet around the building. These designs require the use of a horizontal support to hold the roof structure. The horizontal support is usually a beam or some type of ledger.

In masonry constructions, ledgers are elongate wood members or steel pieces with angle iron configurations. Anchor bolts attach the wood legers to a wall structure in the same manner that Nelson studs attach the steel ledgers to a wall. As shown in FIG. 1, Nelson studs lie welded to the back of the steel angle iron and extend into a masonry structure.

In securing a wood ledger to a wall structure one would install the anchor bolts into the hollows of masonry units, pour grout or concrete into the hollows of the masonry units, adjust the bolts to place them in proper positions, drill the wood member with openings for the bolts, slip the bolts through the openings in the wood member, and secure the wood member to the wall with nuts and washers. The prior method of securing a metal ledger to a wall unit has a similar set of steps.

Prior to 1988, the holes that received the anchor bolts and Nelson studs in the masonry units had a size that was large enough to merely accommodate the bolts and studs. However, after 1988, building codes required "[a]ll bolts to be grouted in place with at least 1 inch of grout between the bolt and the masonry" (see FIG. 2). This change in the building code required, in essence, suspension of the anchor bolts or the Nelson studs of a steel ledger in the larger holes until the grout or concrete secured them in this position.

One prior method of accomplishing this result with a steel ledger includes drilling holes in the masonry above and below the steel ledger, placing wire through the holes and around the ledger, and tying the wire to secure the ledger to the masonry (see FIG. 3). The disadvantage to this approach is having to perform additional procedures such as cutting and removing the wire. Also, the holes in the masonry require patching in applications where the masonry remains exposed.

A second prior method of suspending the Nelson bolts of a steel ledger involves positioning a temporary wood support such as a two-by-four perpendicularly to the ledger (or generally parallel to the face of the masonry wall), as shown in FIG. 4, and securing the support with shot pin nails. This procedure has a number of disadvantages. First, it requires a supply of wood which increases the cost of the procedure. Also, it requires the removal of the temporary supports and the patching of holes left by the shot pin nails.

Another prior method similar to the second approach outlined above involves inserting anchor bolts into a wood ledger prior to its placement and using wood elements and shot pins through the elements and the ledger to support the wood ledger. The arrangement provided by this method is similar to the one shown in FIG. 4, and it suffers the same disadvantages. It requires an additional supply of wood; and it requires the removal of temporary supports and the patching of holes left by the shot pin nails.

The system and method of the present invention avoids the disadvantages of the prior art systems and methods. It allows quick and easy installation of masonry ledgers or other such connectors. It does not require temporary supports or removal of any materials after it fulfills its temporary function of suspending the ledger to allow grout or concrete placement. It is a simple and cost-effective approach to ledger installation which minimizes the cost of labor and the cost of materials.

SUMMARY OF THE INVENTION

In accordance with the embodiments of the present invention, the system for forming a structural connection for a hollow building structure includes a structural member with a body segment and an anchor segment, a plurality of strips for engaging edge portions of the body segment of the structural member, and securing means for securing the strips to the building structure. The anchor segment of the structural member extends into the building structure through an opening in the building, while the body segment engages a face of the building structure proximate the opening. At least one of the strips extends around an edge portion of the body segment.

The method of the present invention includes the steps of: (a) providing a structural member with a body segment and an anchor segment; (b) inserting the anchor segment of the structural member through an opening in a hollow building structure; (c) securing a plurality of strips to the building structures proximate the body segment so that the strips engage the body segment; and (d) having one of the strips extend around an edge portion of the body segment.

BRIEF DESCRIPTION OF THE DRAWINGS

For a more complete understanding of this invention, one should now refer to the embodiments illustrated in greater detail in the accompanying drawings as described below as examples of the invention. In the drawings.

While the following disclosure describes the invention in connection with a number of embodiments, one should understand that the invention is not limited to these embodiments. Furthermore, one should understand that the drawings are not to scale and that graphic symbols, diagrammatic representations, and fragmentary views, in part, may illustrate the embodiments. In certain instances, the disclosure may not include details which are necessary for an understanding of the present invention.

DESCRIPTION OF THE DRAWINGS

Figure 1:
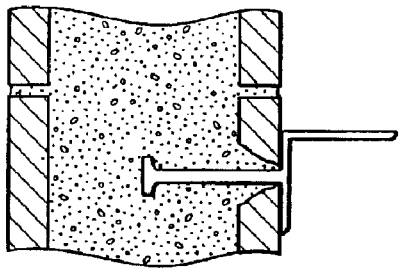
FIG. 1 PRIOR ART
FIG. 1 is a sectional view showing a prior art ledger installation for a masonry building structure.
Figure 2:
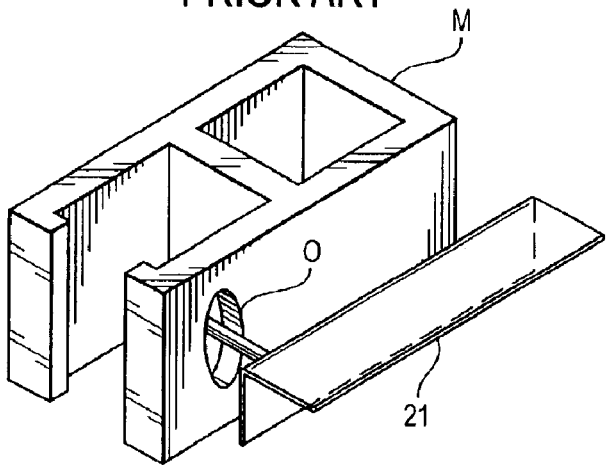
FIG. 2 PRIOR ART
FIG. 2 is a perspective view of a hollow masonry building element and a steel ledger, showing an anchor segment (Nelson stud) of the ledger extending into the building element through an opening in the building element.
Figure 3:
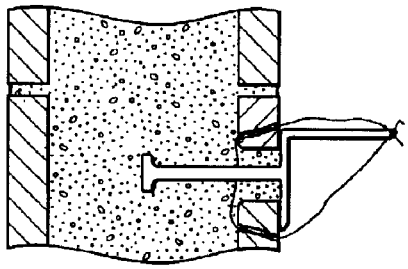
FIG. 3 PRIOR ART
FIG. 3 is a sectional view showing a second prior art ledger installation.
Figure 4:
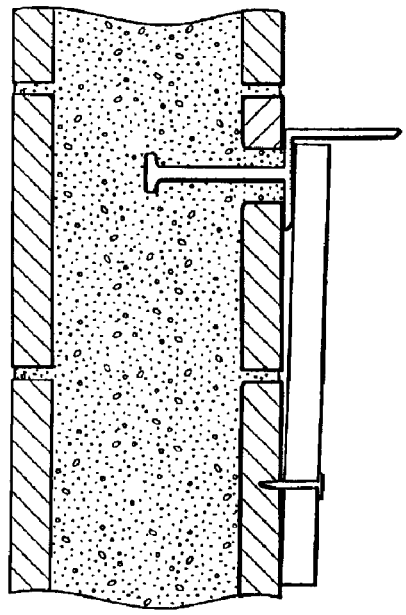
FIG. 4 PRIOR ART
FIG. 4 is a sectional view showing a third prior art ledger installation.

Turning now to the drawings and referring specifically to FIGS. 5–8, the structural connection forming system 20 of the present invention generally includes a structural member 21, a pair of first strips 22, a second strip 23 and a nail anchor 24 for each of the strips 22 and 23. The structural member 21 includes a body segment made of steel or any other material of high strength and rigidity and having the form of an angle iron. This member 21 also includes one or more anchor segments (e.g., a Nelson stud, see FIG. 2) fixedly secured (e.g., welded) to the back of the body segment. The anchor segments extend into the hollow masonry elements M through openings O and into the inner cavities for the elements M where grout or concrete ultimately engulfs them and secures them to the elements M.

Figure 5:
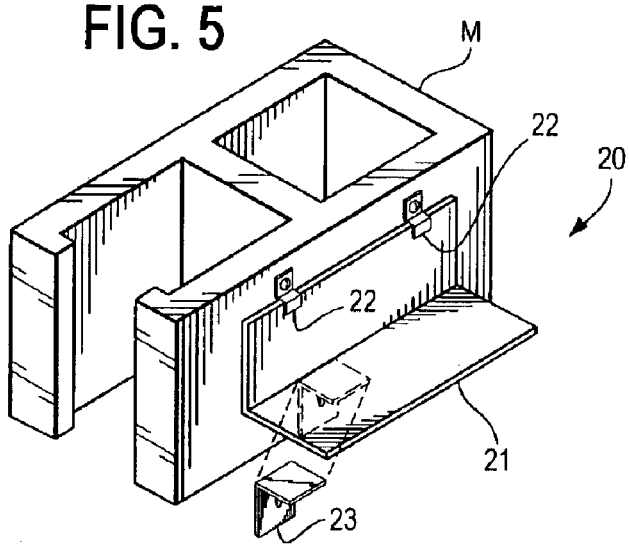
FIG. 5 is a perspective view of the system of the present invention; including a structural member and a plurality of strips for engaging the structural member.

As an alternate to the structural member 21 shown in FIG. 5, an elongate wood piece may serve as the body segment of the structural member; and one or more anchor bolts secured to the wood piece may serve as the anchor segment. In this alternative, the strips may have a different configuration to accommodate the increased thickness of the wood piece.

Figure 7:
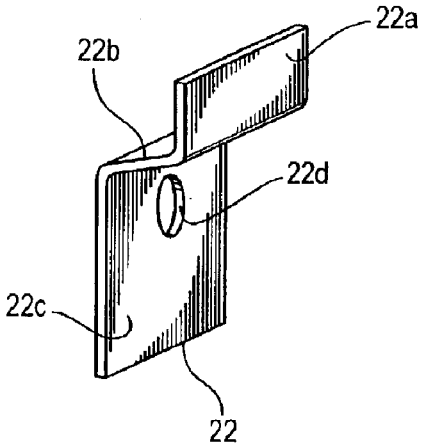
FIG. 7 is a perspective view of another type of strip that engages the structural member.

The first strip 22 is thin and elongate; and it has the generally Z-shaped configuration of a bracket clip with portions 22*a*, 22*b*, 22*c* (see FIG. 7). It is made of stainless steel sheet metal, galvanized sheet metal or any other high strength material, as is the strip 23. The portion 22*c* of this strip 22 defines an opening 22*d* through which a nail anchor 24 extends to secure the strip to the masonry element M. (Although the embodiments shown use nail anchors 24, any other suitable anchor may serve as substitutes to perform the anchoring function). The portions 22*a* and 22*b* engage an edge portion of the body segment of the structural member 21 to secure this structural element to the masonry element M.

Figure 6:
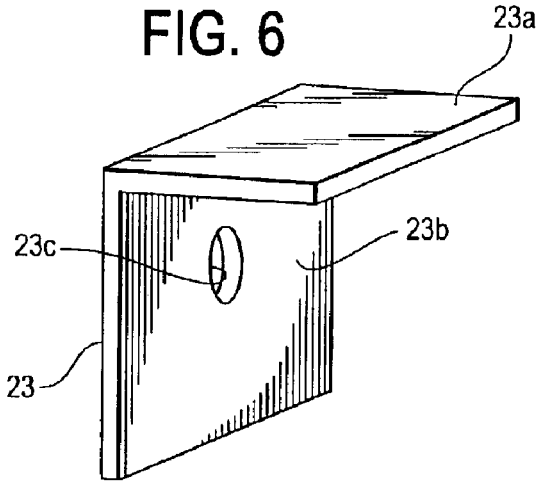
FIG. 6 is a perspective view of one type of strip that engages the structural member.
Figure 8:
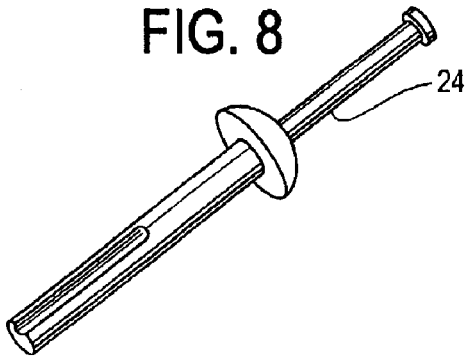
FIG. 8 is a perspective view of a nail anchor used to secure the strips to a building element such as the masonry building element shown in FIG. 5.

The second strip 23 is also generally thin and elongate; and it has an L-shaped, angle iron configuration with a portion 23*a* and a portion 23*b* (see FIG. 6). The portion 23*b* defines an opening 23*c* through which a nail anchor 24 extends to secure the secured strip 23 to the masonry element M. (Alternatively, the portion 23*b* defines two openings 23*c* to allow for optional anchor locations; and the portion 23*a* defines an opening to allow for the attachment of a structural member 21 with a nail or screw). The portion 23*a* serves as a pedestal for the structural member 21. As shown in FIG. 5, the second strip 23 co-operates with the two first strips 22 to secure the structural member 21 against the masonry element M so that the anchor segment of the member 21 extends through the middle of opening O in the masonry element M.

Figure 9:
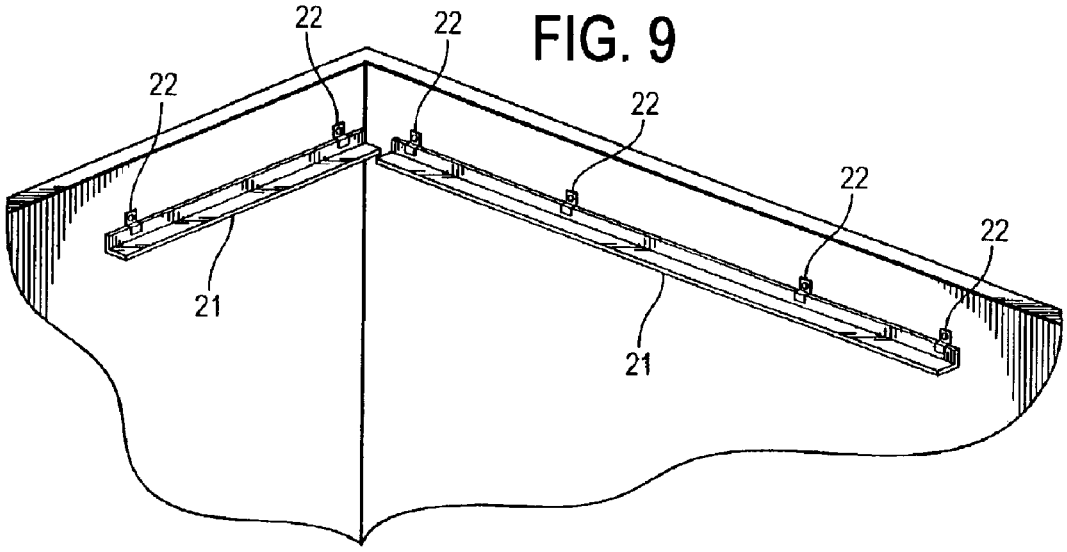
FIG. 9 is a perspective view of a ledger installation using the system of the present invention.

A relatively short ledger, like the one shown in FIG. 5, requires only the first strips 22 and one second strip 23. However, other, longer structural members 21 require more of these strips. For example, the ledgers shown in FIG. 9 and used to support the roof of a building require a larger number of first and second strips 22 and 23.

Figure 10:
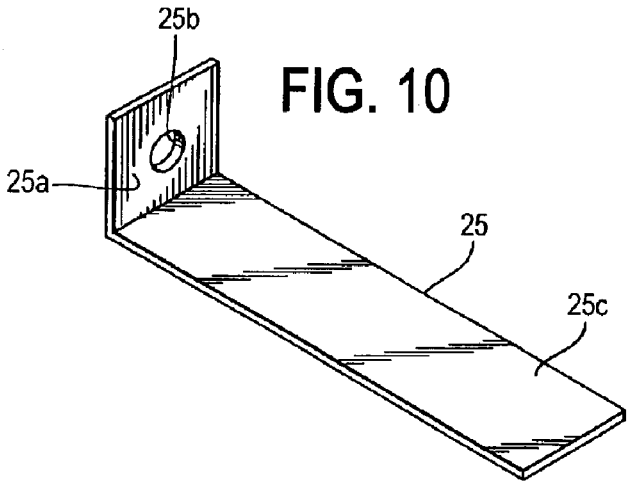
FIG. 10 is a perspective view of yet another strip used to engage a structural element.

A third strip 25, like the first and second strips 22 and 23, is generally thin and elongate; and it is made of the same or similar material as the strips 22 and 23. It includes a portion 25*a* that defines an opening 25*b* through which a nail anchor 24 extends to secure the strip 25 to a building element, (see FIG. 10). It also includes a portion 25*c* that extends generally perpendicularly to the portion 25*a*. Although FIG. 10 shows the distal end of the portion 25*c* as straight, in an installation, this distal end has a U-shaped configuration that wraps around an outwardly disposed edge portion of a structural member 21, i.e., an edge portion that lies outwardly of the building element that receives the structural element 21 (see FIG. 11). During the installation process, the installer forms the U-shaped configuration by bending the distal end to wrap around the structural member 21.

Figure 11:
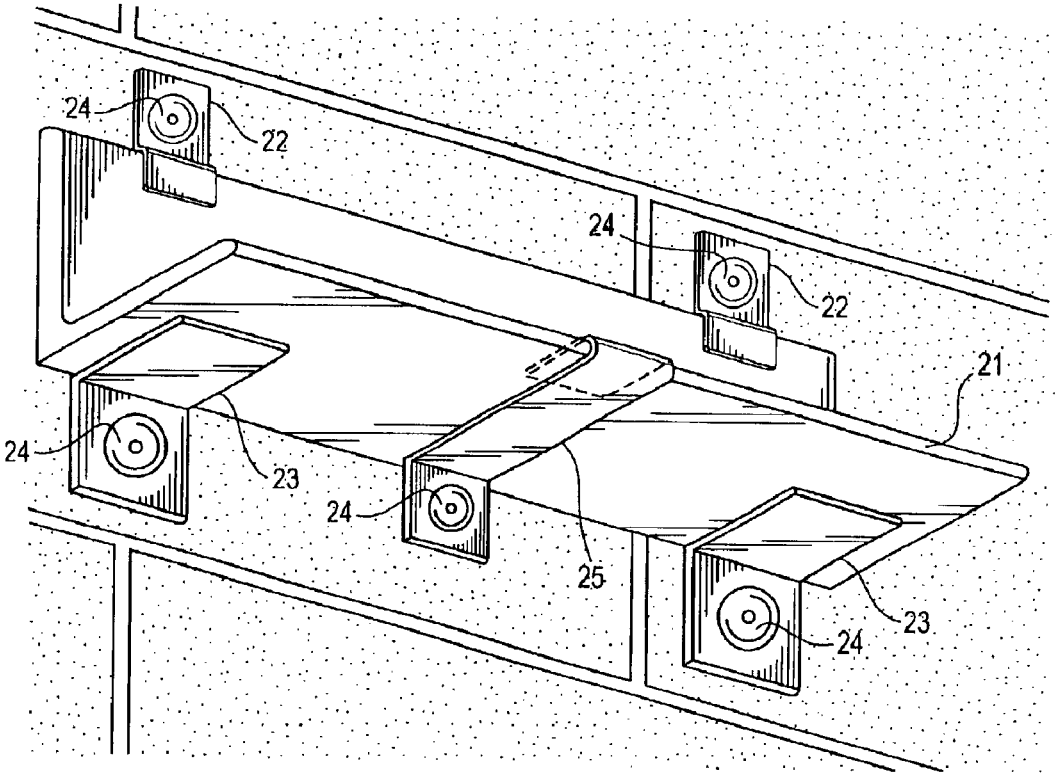
FIG. 11 is a perspective view of a second ledger installation using the system of the present invention.

FIGS. 11–16 show various installations using the present invention. FIG. 11 shows a ledger installation with a structural member 21 secured to a masonry wall with a pair of second strips 23 upon which the member 21 rests, a pair of first strips 22 that extend around the top edge portions of the member, and a third strip 25 which extends around the outwardly disposed edge of member 21. As stated above, these strips 22, 23 and 25 secure the element 21 against the wall which comprises hollow masonry elements. They hold the member 21 in a predetermined position, assuring the proper clearance between the anchor segment of the member 21 and the sides of the opening through which the anchor segment extends into the hollow of the masonry units. And, although the strips 22, 23 and 25 need not continue to support the structural member 21 once grout or concrete has filled the hollows of the building elements and hardened, they can remain permanently in place, obviating removal and patching procedures.

Figure 12:
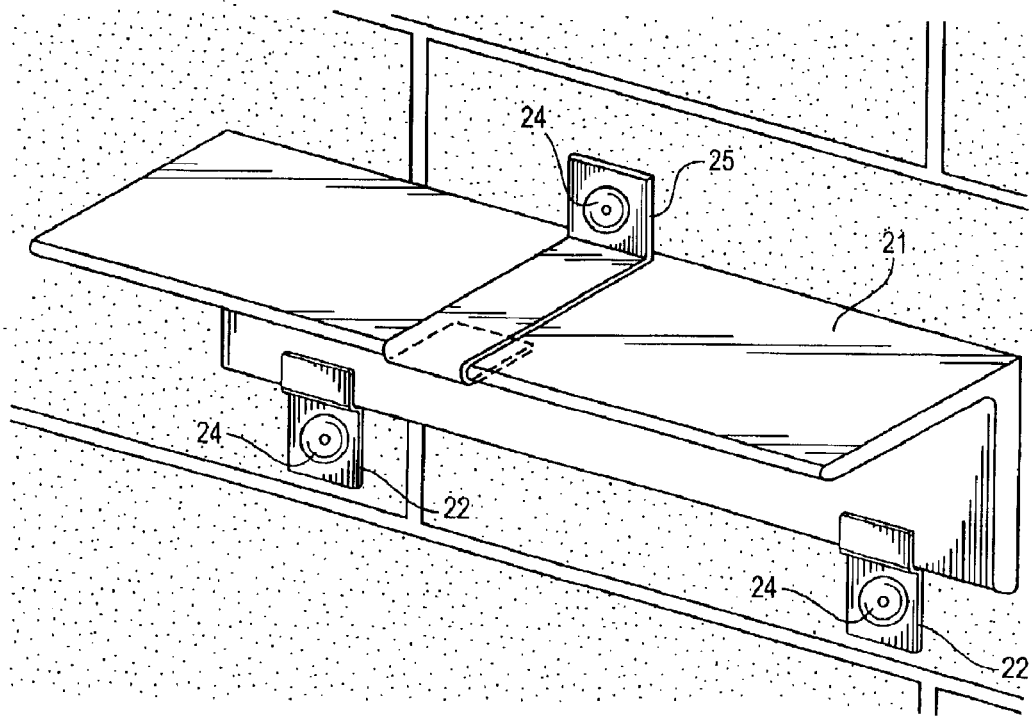
FIG. 12 is a perspective view of a third ledger installation using the system of the present invention.
Figure 13:
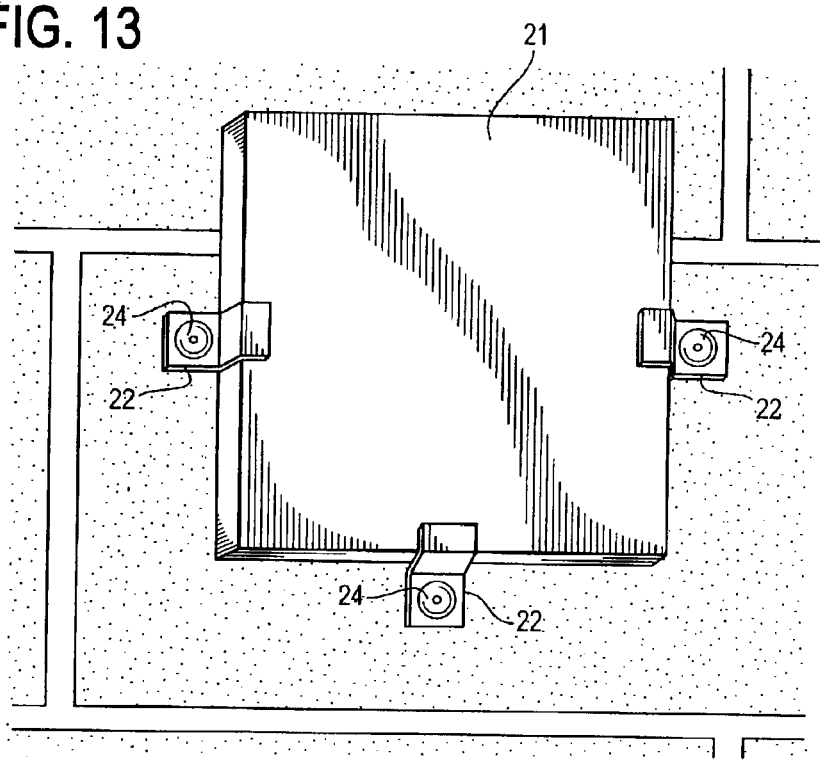
FIG. 13 is a perspective view of a fourth ledger installation using the system of the present invention.
Figure 14:
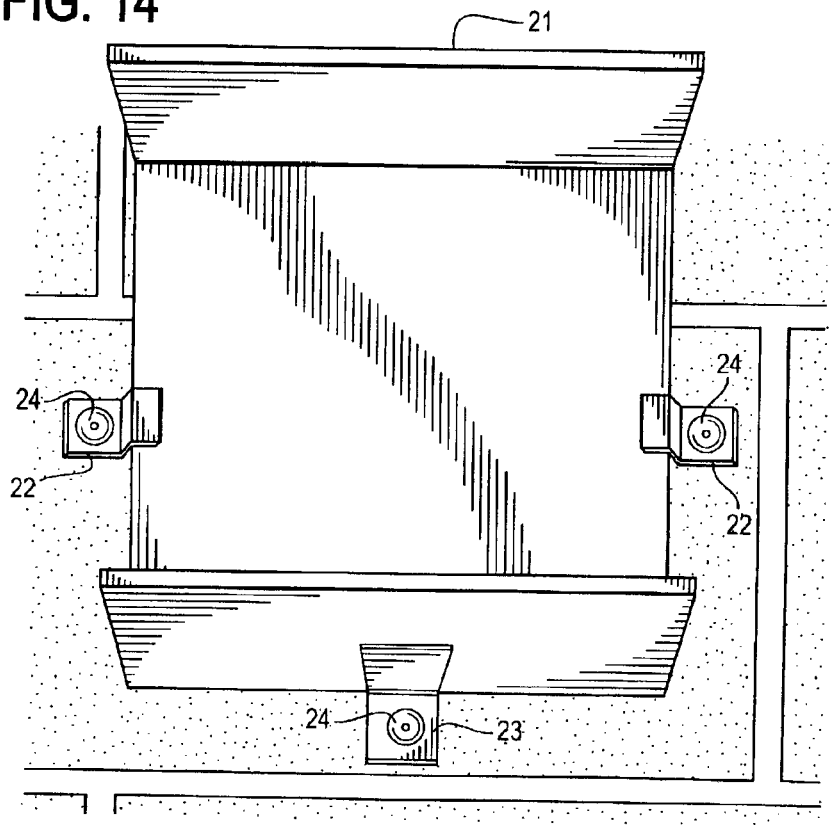
FIG. 14 is a perspective view of a fifth ledger installation using the system of the present invention.
Figure 15:
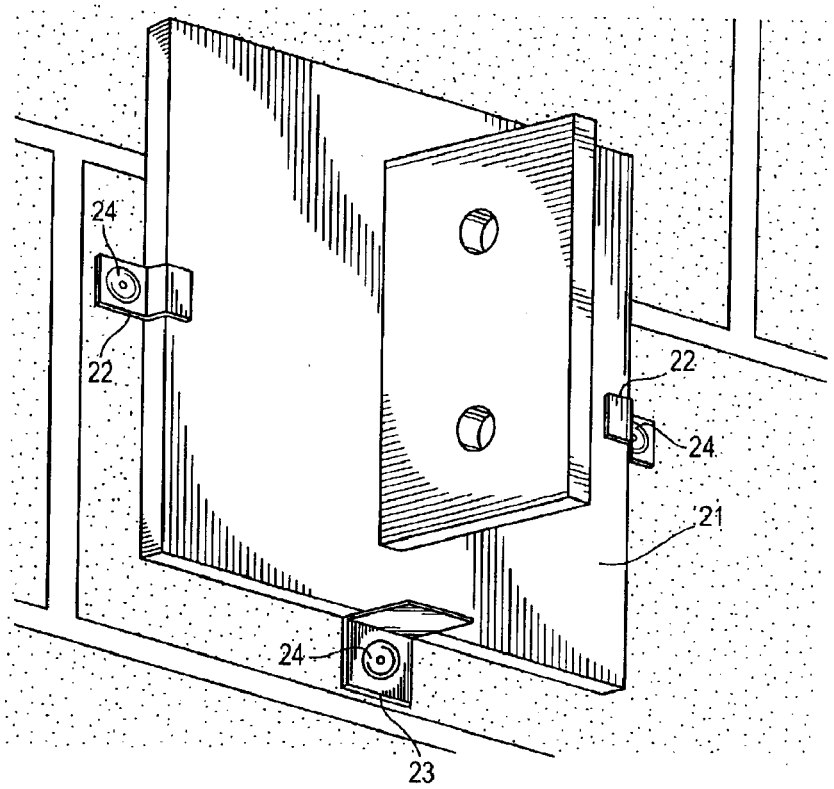
FIG. 15 is a perspective view of a sixth ledger installation using the system of the present invention.
Figure 16:
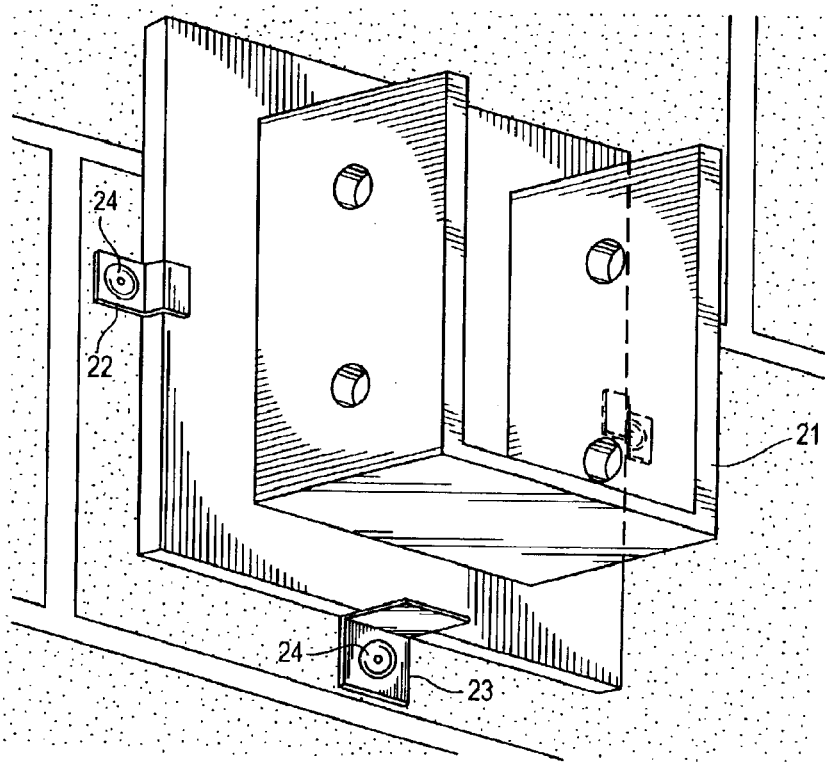
FIG. 16 is a perspective view of a seventh ledger installation using the system of the present invention.

In the remaining figures, FIGS. 12–16, various arrangements of these strips 22, 23 and 25 similarly secure a structural member 21 to a building unit. FIG. 12 shows the ledger 21 of FIG. 11 positioned differently and secured by a pair of first strips 22 and a third strip 25. FIG. 13 shows a structural plate member 21 secure by three first strips 22. FIGS. 14, 15 and 16 shows a different structural beam support member 21 secured by two first strips 22 and a second strip 25.

The method of forming the structural connections of the present invention includes first providing a structural member 21 with a body segment and an anchor segment. It then includes inserting the anchor segment through an opening in a hollow building structure and securing a plurality of the strips 22, 23 and/or 25 to the building structure proximate the body segment of the structural member so that the strips engage the body segment.

While the above description and the drawings disclose and illustrate a number of embodiments, one should understand, of course, that the invention is not limited to these embodiments. Those skilled in the art to which the invention pertains may make other modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A system of forming a structural connection between a hollow building structure and a structural member including a body segment engaging the building structure and an anchor segment extending through an opening into the hollow building structure, comprising a plurality of strip members for engaging edge portions of the body segment, and for retaining the structural member in place on the building structure while the hollow building structure and the opening are filled with and the anchor segment is encased within concrete or grout and at least until the concrete or grout has set, and securing means for securing the strip members to the building structure.

2. The system of claim 1, wherein one of the strip members extends around an edge portion of the body segment.

3. The system of claim 2, wherein the strip member that extends around an edge portion of the body segment has a step-like configuration.

4. The system of claim 1, wherein the strip members are flat strips of metal.

5. The system of claim 1, wherein the plurality of strip members includes at least two of a first strip member having a step-like configuration, and extending around an edge portion of the body segment, a second strip member having an angle iron-like configuration and engaging a bottom edge portion of the body segment, and an elongate third strip member having a U-shaped end portion and extending around an outwardly disposed edge portion of the body segment.

6. The system of claim 1, wherein the body segment is an angle iron and the anchor segment is a Nelson stud.

7. The system of claim 1, wherein the securing means are nail anchors.

8. A system of forming a structural connection between a hollow building structure and a structural member including a body segment engaging the building structure and an anchor segment extending through an opening into the hollow building structure; comprising a first strip member having a step-like configuration, and extending around an edge portion of the body segment; a second strip member having an angle iron-like configuration and engaging a bottom edge portion of the body segment; and an elongate third strip member having a U-shaped end portion and extending around an outwardly disposed edge portion of the body segment, and securing means for securing said strip members to the building structure, said strip members retaining the structural member in place on the building structure while the hollow building structure and the opening are filled with and the anchor segment is encased within concrete or grout and at least until the concrete or grout has set.

9. The system of claim 8, wherein the body segment is an angle iron and the anchor segment is a Nelson stud.

10. The system of claim 9, wherein the securing means are nail anchors.

11. A method of forming a structural connection with a hollow building structure, the method comprising the steps of providing a structural member including a body segment and an anchor segment; engaging the body segment of the structural member with the hollow building structure and inserting the anchor segment of the structural member through an opening in the hollow building structure; securing a plurality of strip members to the building structure proximate the body segment so that the strip members engage the body segment and retain the structural member in place on the building structure; and pouring concrete or grout into the hollow building structure and the opening therein and encasing the anchor element in concrete or grout while the structural member is retained in place by the strip members at least until the concrete or grout has set.

12. The method of claim 11 further comprising placing of the strip members around an edge portion of the body segment.

13. The method of claim 11 wherein the strip members include at least one strip member having a step like configuration extending around an edge portion of the body segment.

14. The method of claim 11 wherein the strip members include at least one strip member having an angle iron configuration engaging a bottom edge portion of the body segment.

15. The method of claim 11 wherein the strip members include at least one elongate strip member having a distal end portion formable to U-shape for extending around an outwardly disposed edge portion of the body segment.

16. A kit for use in practice of the method of claim 11, comprising at least one clip, each said clip having a wall mounting portion with an aperture for receiving an anchor and a L-shaped portion for engaging an edge of the structural member, at least one angle iron pedestal, each said pedestal having a wall mounting portion with an aperture for receiving an anchor and a supporting portion extending substantially perpendicular from the wall mounting portion for supporting the structural member, and at least one elongate strip member, each said member having a wall mounting portion with an aperture for receiving an anchor and an elongated portion extending substantially perpendicular from the wall mounting portion and having a distal end formable about an outwardly disposed edge of the structural member.

17. A kit as set forth in claim 16 including a plurality of anchors.

18. A kit for installing a structural member on a masonry structure, comprising at least one clip, each said clip having a wall mounting portion with an aperture for receiving an anchor and a L-shaped portion for engaging an edge of the structural member, at least one angle iron pedestal, each said pedestal having a wall mounting portion with an aperture for receiving an anchor and a supporting portion extending substantially perpendicular from the wall mounting portion for supporting the structural member; and at least one elongated strip member, each said member having a wall mounting portion with an aperture for receiving an anchor and an elongated portion extending substantially perpendicular from the wall mounting portion and having a distal end formable about an outwardly disposed edge of the structural member.

19. A kit as set forth in claim 18 including a plurality of anchors.

20. A kit as set forth in claim 18 including a plurality of nail anchors.

* * * * *

UNITED STATES PATENT AND TRADEMARK OFFICE

CERTIFICATE OF CORRECTION

PATENT NO. : 7,055,289 B2
APPLICATION NO. : 10/412930
DATED : June 6, 2006
INVENTOR(S) : Guth It is certified that error appears in the above-identified patent and that said Letters Patent is hereby corrected as shown below:

Column 5, line 32 ,claim 5, after “configuration” delete the “,” (comma).

Signed and Sealed this

Fifth Day of September, 2006

JON W. DUDAS
*Director of the United States Patent and Trademark Office*